US008601946B2

(12) United States Patent
Greive et al.

(10) Patent No.: US 8,601,946 B2
(45) Date of Patent: Dec. 10, 2013

(54) METHOD AND APPARATUS FOR AUTOMATICALLY FEEDING PRINTING PLATES AND PRINTING PRESS HAVING THE APPARATUS

(75) Inventors: Martin Greive, Schriesheim (DE); Alexander Knabe, Heidelberg (DE); Stephan Rudzewitz, Walldorf (DE); Mathias Zuber, Helmstadt-Bargen (DE); Oliver Lang, Ilshofen (DE); Dirk Schönmann, Schifferstadt (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 947 days.

(21) Appl. No.: 12/629,329

(22) Filed: Dec. 2, 2009

(65) Prior Publication Data

US 2010/0154664 A1 Jun. 24, 2010

(30) Foreign Application Priority Data

Dec. 2, 2008 (DE) ..... 10 2008 060 083

(51) Int. Cl.
*B41F 27/12* (2006.01)

(52) U.S. Cl.
USPC ..... 101/477; 101/481; 101/486; 101/DIG. 36

(58) Field of Classification Search
USPC ..... 271/184; 101/378, 382.1, 383, 481, 101/477, 485, 486, DIG. 36
See application file for complete search history.

(56) References Cited

U.S. PATENT DOCUMENTS

| | | | | |
|---|---|---|---|---|
| 4,748,911 | A | 6/1988 | Kobler | |
| 5,555,810 | A * | 9/1996 | Stiel | 101/477 |
| 5,555,812 | A * | 9/1996 | Ruckmann et al. | 101/477 |
| 5,634,406 | A | 6/1997 | Lindner et al. | |
| 6,032,581 | A | 3/2000 | Beutler et al. | |
| 6,135,027 | A * | 10/2000 | Rudzewitz et al. | 101/415.1 |
| 6,199,280 | B1 | 3/2001 | Schneider et al. | |
| 6,463,854 | B1 * | 10/2002 | Rautert et al. | 101/481 |
| 6,480,697 | B2 * | 11/2002 | Kojima | 399/404 |

(Continued)

FOREIGN PATENT DOCUMENTS

| | | |
|---|---|---|
| CN | 1255089 A | 5/2000 |
| CN | 101239528 A | 8/2008 |

(Continued)

OTHER PUBLICATIONS

German Search Report dated Aug. 28, 2009.

*Primary Examiner* — Ren Yan
*Assistant Examiner* — Marissa Ferguson Samreth
(74) *Attorney, Agent, or Firm* — Laurence A. Greenberg; Werner H. Stemer; Ralph E. Locher

(57) ABSTRACT

A method and an apparatus for automatically feeding printing plates to a rotary printing press include conveying devices spaced apart from each other transversely to a conveying direction for feeding the printing plate to a clamping device having register pins. One of the conveying devices is lifted briefly off the printing plate in the event of a lack of in-register contact while the other conveying device remains in contact with the printing plate and thus ensures a forward drive of the printing plate, while the lifting of one conveying device promotes stress relief in the printing plate. A sheetfed rotary printing press having the apparatus, is also provided.

5 Claims, 5 Drawing Sheets

(56) References Cited

U.S. PATENT DOCUMENTS

| | | | | |
|---|---|---|---|---|
| 6,571,708 | B1 | 6/2003 | Rudzewitz et al. | |
| 6,845,713 | B1 * | 1/2005 | Schumann et al. | 101/477 |
| 7,730,836 | B2 | 6/2010 | Schnell | |
| 8,181,573 | B2 * | 5/2012 | Greive et al. | 101/477 |
| 8,210,104 | B2 * | 7/2012 | Funk et al. | 101/486 |
| 2005/0229802 | A1 | 10/2005 | Edamitsu et al. | |

FOREIGN PATENT DOCUMENTS

| | | | |
|---|---|---|---|
| DE | 4439623 | C2 | 1/1999 |
| DE | 19839149 | C1 | 1/2000 |
| DE | 102004022083 | B3 | 10/2005 |
| EP | 0933207 | A1 | 8/1999 |
| JP | 11262997 | A | 9/1999 |
| JP | 2000289188 | A | 10/2000 |

* cited by examiner

METHOD AND APPARATUS FOR AUTOMATICALLY FEEDING PRINTING PLATES AND PRINTING PRESS HAVING THE APPARATUS

CROSS-REFERENCE TO RELATED APPLICATION

This application claims the priority, under 35 U.S.C. §119, of German Patent Application DE 10 2008 060 083.0, filed Dec. 2, 2008; the prior application is herewith incorporated by reference in its entirety.

BACKGROUND OF THE INVENTION

FIELD OF THE INVENTION

The invention relates to a method and an apparatus for the automatic feeding of printing plates to a cylinder of a printing press, in particular a plate cylinder. The invention also relates to a printing press having the apparatus.

When changing a printing plate, in particular when feeding a new printing plate to the plate cylinder of a printing press, the in-register clamping of the printing plate is of great importance, since printing plates that are not clamped in register lead to rejects and, in particular in printing presses having a large number of printing units, printing plates not fed in register would have to be corrected manually, which would lead to a prolongation of changeover times.

German Patent DE 44 39 623 C2, corresponding to U.S. Pat. No. 5,634,406, has already disclosed a method for the automatic feeding of printing plates to the plate cylinder of a sheetfed offset printing press, in which, through the use of a conveying device that can be brought into contact with the printing plate, the leading edge of the printing plate is guided into a clamping rail of the plate cylinder and the in-register contact of the printing plate is checked in the clamping rail, after which, if the position is in register, the printing plate is fixed in the clamping rail. However, if the printing plate has in-register contact only at one location of the clamping rail, the contact between the conveying device and the printing plate is broken for a predefined time interval and then the contact between printing plate and conveying device is produced again.

SUMMARY OF THE INVENTION

It is accordingly an object of the invention to provide a method and an apparatus for automatically feeding printing plates and a printing press having the apparatus, which overcome the hereinafore-mentioned disadvantages of the heretofore-known methods and devices of this general type and which permit the automatic in-register feeding of a printing plate into a clamping rail of a plate cylinder.

With the foregoing and other objects in view there is provided, in accordance with the invention, a method for automatically feeding printing plates to a plate cylinder of a printing press. The method comprises guiding a leading edge of a printing plate into a clamping rail of the plate cylinder using conveying devices to be brought into contact with the printing plate, checking an in-register contact of the printing plate in the clamping rail at two locations of the clamping rail being spaced apart from each other in axial direction of the plate cylinder, subsequently fixing the printing plate in the clamping rail if a position is in register, and if the printing plate has in-register contact only at one location of the clamping rail, breaking contact between a first one of the conveying devices and the printing plate for a predefined time interval and then producing a contact between the printing plate and the conveying devices again, while a second one of the conveying devices remains in contact with the printing plate.

With the objects of the invention in view, there is also provided an apparatus for automatically feeding printing plates to a plate cylinder of a printing press. The apparatus comprises conveying devices to be brought into and out of contact with a printing plate for interacting with the printing plate. The conveying devices are disposed at a distance from each other transversely relative to a conveying direction. Actuating devices are each associated with a respective one of the conveying devices and are configured to be driven independently of one another.

In a particularly advantageous way, the contact between the conveying device and the printing plate is not broken completely, so that a defined retaining force is exerted on the printing plate. Partial release of the printing plate by the clamping device promotes the relief of the stresses in the printing plate and makes the in-register feeding easier.

A particularly advantageous measure is isolating those conveying devices which are assigned to a register pin that has signaled in-register contact.

In the case of a simple control, provision can be made for it to always only be that conveying device for the printing plate which is assigned to an angular register pin that is isolated, since the latter generally has a lateral clearance with respect to a rectangular printing plate punching and thus permits relief of the stresses in the printing plate transversely with respect to the transport direction.

A preferred apparatus has two actuating devices that can be driven independently of each other, in particular pneumatic cylinders, for isolating and throwing off the conveying device from the printing plate to be conveyed.

With the objects of the invention in view, there is concomitantly provided a sheetfed rotary printing press, comprising an apparatus according to the invention.

Other features which are considered as characteristic for the invention are set forth in the appended claims.

Although the invention is illustrated and described herein as embodied in a method and an apparatus for automatically feeding printing plates and a printing press having the apparatus, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
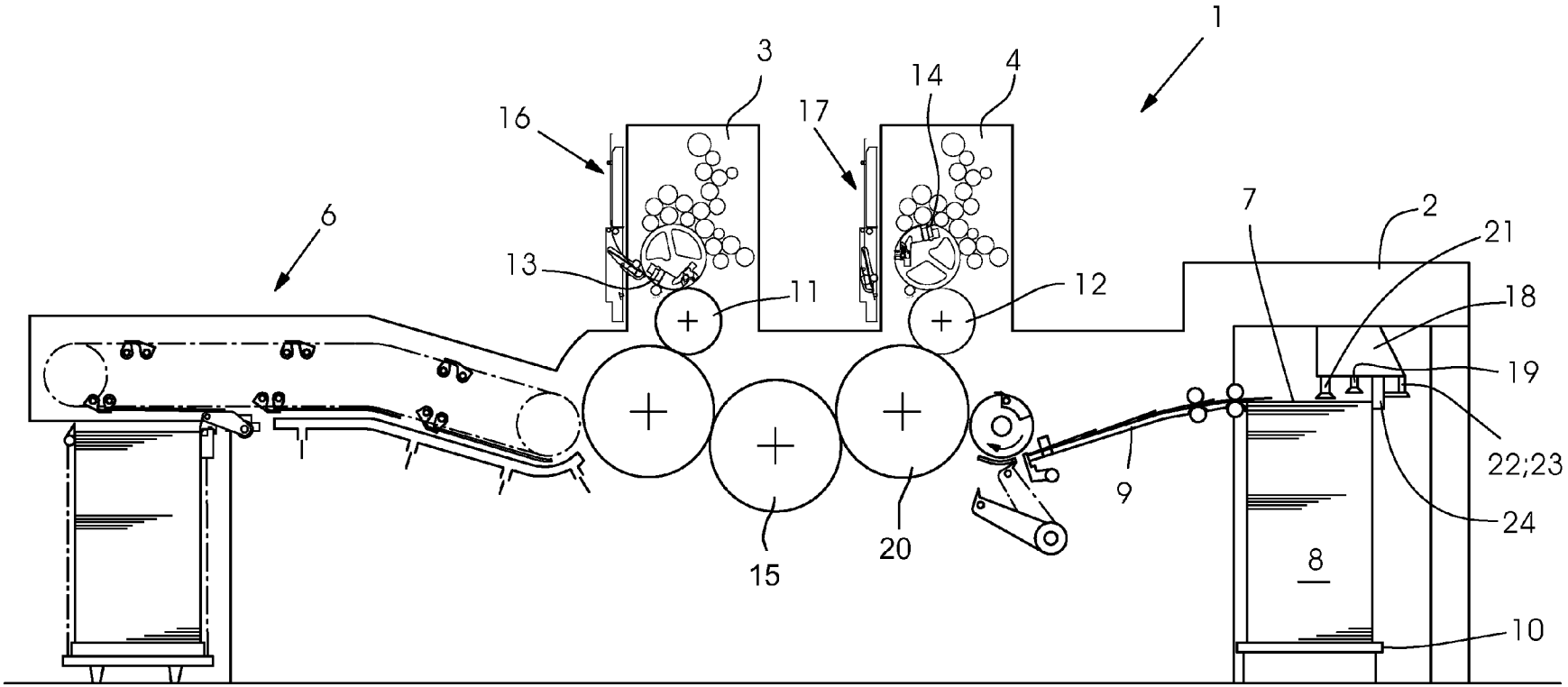
FIG. 1 is a diagrammatic, longitudinal-sectional view of a sheetfed rotary printing press.

Referring now to the figures of the drawings in detail and first, particularly, to FIG. 1 thereof, there is seen a machine for processing sheets 7, for example a printing press 1, which has a feeder 2, at least one printing unit 3, 4 and a delivery 6. The sheets 7 are taken from a sheet stack 8 and, separated or in overlapping formation, are fed over a feed table 9 to the printing units 3, 4. The latter each contain, in a known manner, a plate cylinder 11, 12 and a blanket cylinder 15, 20 interacting therewith in each case. The plate cylinders 11, 12 each have a respective clamping apparatus 13, 14 for fixing flexible printing plates. Moreover, each plate cylinder 11, 12 is assigned an apparatus 16, 17 for semiautomatic or fully automatic printing plate change.

The sheet stack 8 rests on a stack board 10 that can be raised under control. The sheets 7 are removed from the top of the sheet stack 8 through the use of a so-called suction head 18 which, amongst other things, has a number of lifting and dragging suckers 19, 21 for separating the sheets 7. Moreover, blowing devices 22 are provided in order to loosen the upper sheet layers, as are sensing elements 23 for stack tracking. A number of side and rear stops 24 are provided in order to align the sheet stack 8, in particular the upper sheets 7 of the sheet stack 8.

Figure 2:
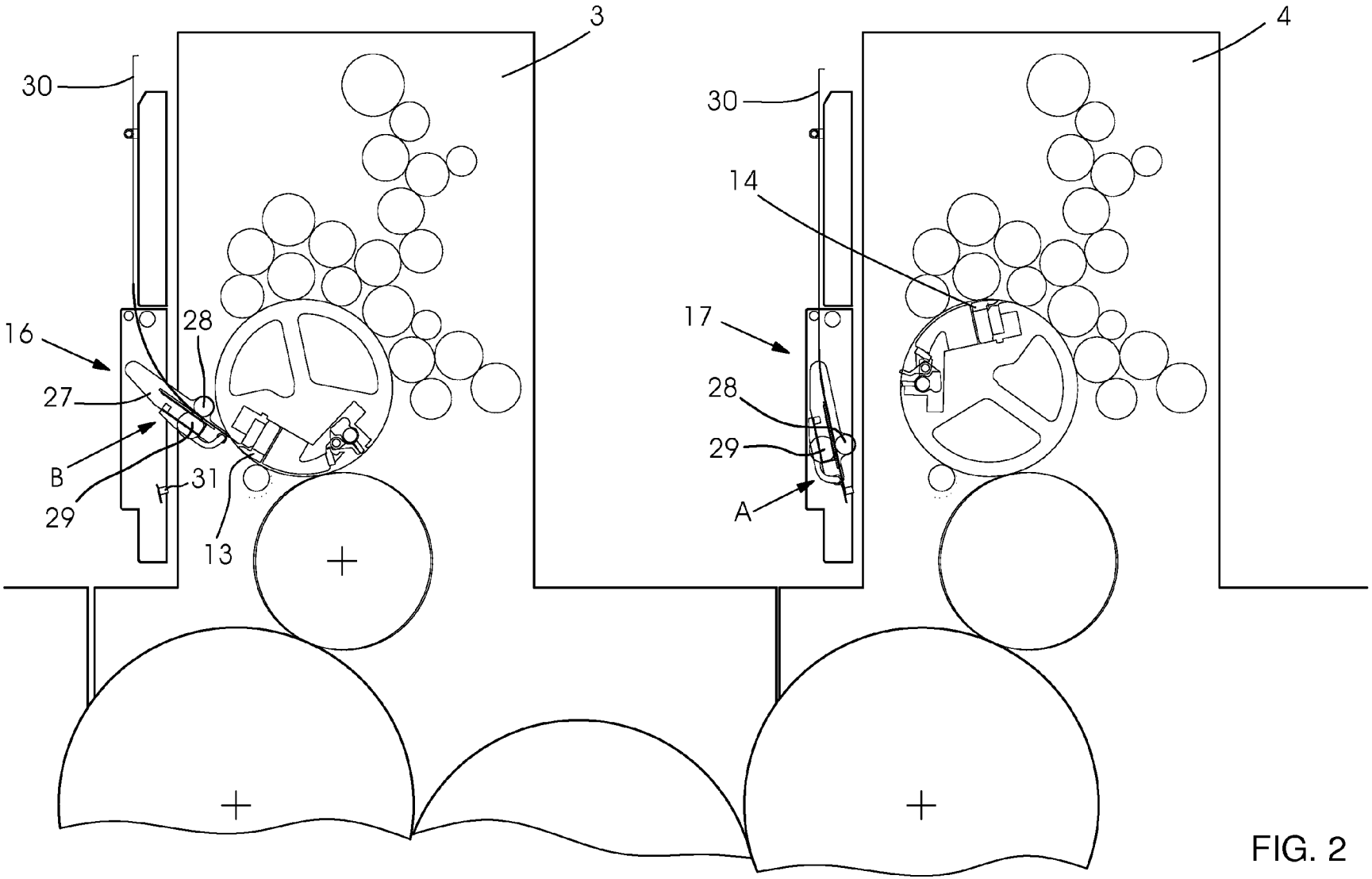
FIG. 2 is an enlarged, fragmentary, longitudinal-sectional view of printing units of the sheetfed rotary printing press.
Figure 3:
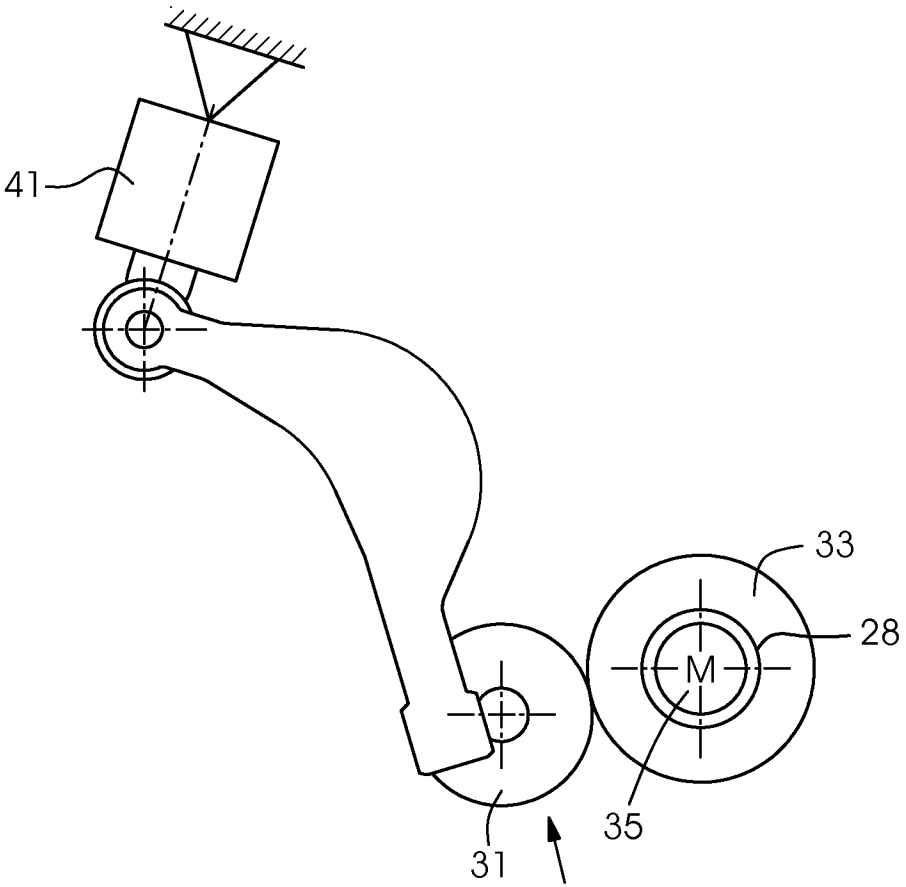
FIG. 3 is a side-elevational view of an actuating device according to the invention for a mating roller operating cylinder.

As is seen in FIG. 2, the printing plate changing apparatus 16, 17 has a pivotable guide device 27 and two interacting conveying devices 28, 29. The conveying device 28 is formed as a drive roller, is mounted in the guide device 27 and is provided with a drive 35, for example a servo motor, as seen in FIG. 3. The conveying device 29, which interacts with the drive roller 28, has at least two mating pressure rollers 31, 32 disposed at a distance from each other, which can be brought pivotably into operative contact with the drive roller 28 and with a printing plate 30 to be fed in.

Figure 4:
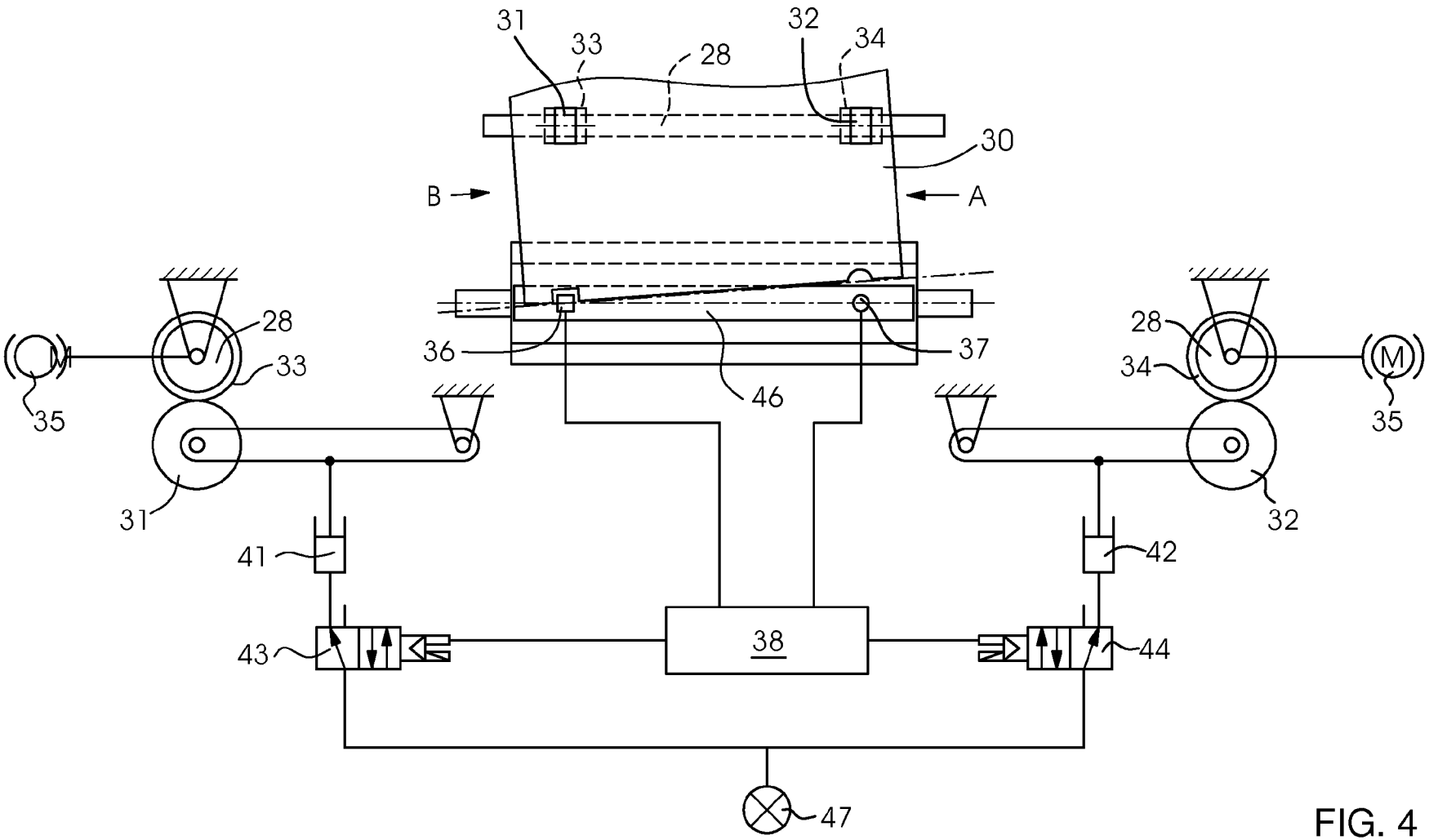
FIG. 4 is a schematic and block diagram showing important components for feeding a printing plate to a plate cylinder of a printing press.
Figure 5:
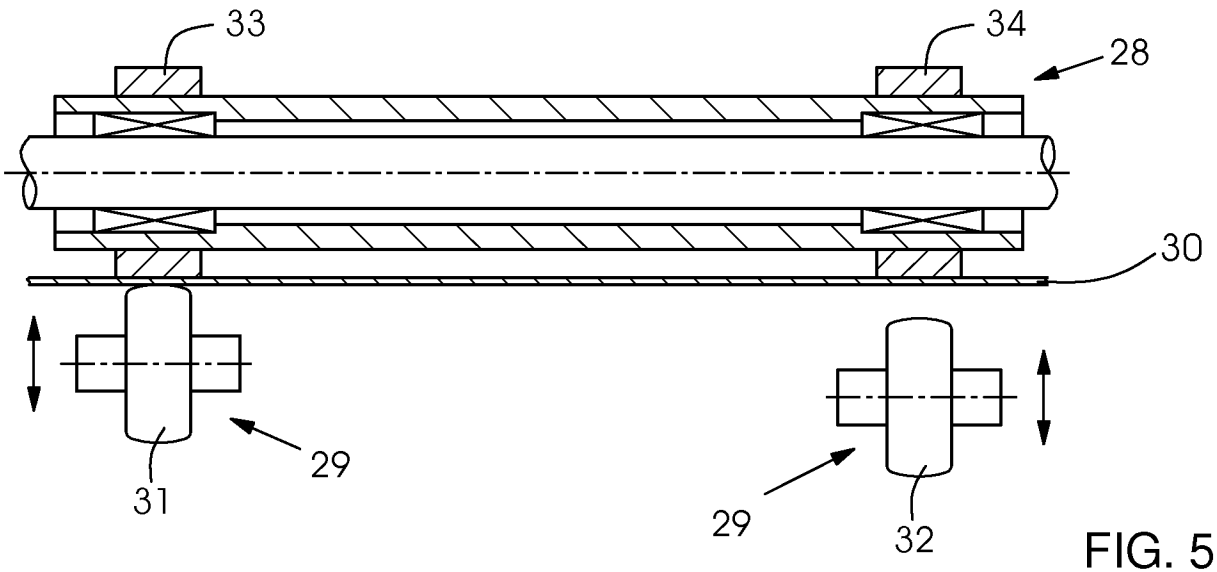
FIG. 5 is a fragmentary, longitudinal-sectional view of a conveying device.

As is seen in FIGS. 4 and 5, the drive roller 28 has running rings 33, 34, which are disposed at a distance from each other and interact with the mating rollers 31, 32 in order to transport the printing plate 30. The number of mating rollers and corresponding running rings 33, 34 can vary, depending on the format width of the printing plate, for example four mating rollers and four running rings. The devices 31, 33; 32, 34 can be referred to as a whole as conveying devices.

As is illustrated diagrammatically in FIG. 4, the mating roller 31 is in operative contact with the running ring 33 of the drive roller 28, and the mating roller 32 is in operative contact with the running ring 34 of the drive roller 28. In this case, the mating roller 31 can be separated from the running ring 33 or thrown onto the latter through the use of an actuating element 41 that can be driven independently, for example an operating cylinder, preferably a pneumatic cylinder.

The mating roller 32 is operatively connected to the running ring 34 and has an actuating element 42 that can be driven independently of the actuating element 41, for example an operating cylinder, in particular a pneumatic cylinder, as diagrammatically shown in the figure.

The operating cylinders 41, 42 are in each case driven through remotely controllable valves 43, 44, which are driven by a control system 38 and connect a compressed air source 47 to the operating cylinders 41, 42 in a controllable manner.

The drive rollers 31, 33 are assigned to a side B, on which a rectangular register pin 36 is disposed, and the drive rollers 32, 34 are assigned to a side A, on which a circular register pin 37 is disposed.

During the feeding of the printing plate 30, the transport rollers 31, 33 and 32, 34 convey the printing plate 30 until the latter rests in register on the register pins 36, 37. This contact is registered through non-illustrated sensors and communicated to the control system 38. The latter generates a signal to clamp the printing plate on a clamping rail 46 of the plate cylinder. If, at an interrogation time for the in-register position, the printing plate 30 is resting in register only on one register pin 36 or 37, one of the pivotably mounted mating rollers 33 or 34 is thrown off, while the respective other roller remains in contact with the printing plate 30. After a short time t (t=about 1-3 seconds), the mating roller 33 or 34 that was previously thrown off is thrown on again. If necessary, this procedure is repeated many times. Through the use of this measure, the printing plate 30 can be relieved of stress but remains in a defined retaining or forward drive position.

In a preferred method, that mating roller 33 on the side at which in-register contact has already been detected, for example the operating side B, is specifically thrown off, while the other mating roller 34 remains in contact with the printing plate 30.

In a further method, irrespective of the side on which the printing plate 30 is not yet resting in register, in principle one and the same mating roller 33 or 34 is thrown off while the other remains in contact with the printing plate 30. Preferably, however, the mating roller 33 which is assigned to the rectangular register pin 36 on the side B is thrown off, since a small lateral clearance is as a rule provided between the register pin and the printing plate stamping, and can be utilized to relieve the stress in the printing plate 30.

The invention claimed is:

1. A method for automatically feeding printing plates to a plate cylinder of a printing press, the method comprising the following steps:

guiding a leading edge of a printing plate into a clamping rail of the plate cylinder using conveying devices having conveying element pairs to be brought into contact with the printing plate, the conveying element pairs being spaced apart from one another along an axial direction of the plate cylinder;

checking an in-register contact of the printing plate in the clamping rail at two locations of the clamping rail being spaced apart from each other in the axial direction of the plate cylinder;

subsequently fixing the printing plate in the clamping rail if a position is in register; and if the printing plate has in-register contact only at one location of the clamping rail, breaking contact between a conveying element of a first one of the conveying element pairs and the printing plate for a predefined time interval and then producing a contact between the printing plate and the conveying element again, while conveying elements of a second one of the conveying element pairs remains in contact with the printing plate.

2. . The method according to claim 1, wherein the printing press is a sheetfed offset printing press.

3. The method according to claim 1, which further comprises specifically breaking the contact between one conveying element and the printing plate on one side at which in-register contact has been determined, while conveying elements of the other conveying element pair remain in contact with the printing plate.

4. The method according to claim 1, which further comprises, providing a register pin with a rectangular cross section at one side and a register pin with a circular cross section at another side, and in the event that there is no in-register contact with the printing plate, bringing the conveying element disposed on the side at which the register pin with the rectangular cross section is disposed out of contact with the printing plate, while keeping conveying elements of the conveying element pair disposed on the side at which the register pin with the circular cross section is disposed in contact with the printing plate.

5. A method for automatically feeding printing plates to a plate cylinder of a printing press, the method comprising the following steps:

guiding a leading edge of a printing plate into a clamping rail of the plate cylinder using roller pairs to be brought into driving contact with the printing plate, the roller pairs being spaced apart from one another along an axial direction of the plate cylinder;

checking an in-register contact of the printing plate in the clamping rail at two locations of the clamping rail being spaced apart from each other in axial direction of the plate cylinder;

subsequently fixing the printing plate in the clamping rail if a position is in register; and if the printing plate has in-register contact only at one location of the clamping rail, breaking driving contact between a first one of the roller pairs and the printing plate for a predefined time interval and then producing a driving contact between the printing plate and the first one of the roller pairs again, while a second one of the roller pairs remains in driving contact with the printing plate.

* * * * *